US006388385B1

(12) United States Patent
McGinn et al.

(10) Patent No.: US 6,388,385 B1
(45) Date of Patent: May 14, 2002

(54) CORRUGATED STYLE ANODE ELEMENT FOR ION PUMPS

(75) Inventors: James B. McGinn, Portland, OR (US); Miriam Spagnol, Turin (IT)

(73) Assignees: FEI Company, Hillsboro, OR (US); Varian, Inc., Palo Alto, CA (US)

( * ) Notice: Subject to any disclaimer, the term of this patent is extended or adjusted under 35 U.S.C. 154(b) by 0 days.

(21) Appl. No.: 09/528,093

(22) Filed: Mar. 17, 2000

Related U.S. Application Data

(60) Provisional application No. 60/125,318, filed on Mar. 19, 1999, and provisional application No. 60/125,317, filed on Mar. 19, 1999.

(51) Int. Cl.[7] ..... H01J 7/18

(52) U.S. Cl. ..... 315/111.91; 315/111.21; 315/111.41; 417/48; 417/49; 417/51

(58) Field of Search ..... 318/111.91, 111.21, 318/111.41; 417/49, 48, 51

(56) References Cited

U.S. PATENT DOCUMENTS 3,070,283 A 12/1962 Hall ..... 230/69
3,319,875 A 5/1967 Jepsen ..... 230/69
4,631,002 A 12/1986 Pierini ..... 417/49
5,646,488 A * 7/1997 Warburton ..... 315/111.81
5,980,212 A * 11/1999 Shen et al. ..... 417/49

OTHER PUBLICATIONS

"Ion Pumps", Varian–Vacuum Products; http://www.vvp-.varian.com/products/ion.htm; Varian Associates, Jan. 1998.
"Technical Notes–Ion Pumps", Varian–Vacuum Products–Technical Notes; http://www.vvp.varian.com/technotes/ion.htm; Varian Associates, Inc., Jan. 1998.
"Theory of Operation" Thermionics Vacuum Products; http://www.thermionics.com/ip–too.htm; Mar. 23, 1998.

* cited by examiner

*Primary Examiner*—Jack Berman
*Assistant Examiner*—Nikita Wells
(74) *Attorney, Agent, or Firm*—Michael O. Scheinberg

(57) ABSTRACT

An ion pump anode eliminates the intercellular spaces while maintaining an efficient cell shape in which the plasma sheath follows the contour of the cell wall. The cell are preferably quasi-cylindrical and can be manufactured by folding one or more metal strip into a corrugation and welding the strip to create separate cells. By eliminating the intercellular region, which support a high plasma density, the formation of dendrites under such a region is prevented and instabilities caused by those dendrites are eliminated.

21 Claims, 5 Drawing Sheets

CORRUGATED STYLE ANODE ELEMENT FOR ION PUMPS

RELATED APPLICATIONS

This application claims priority from U.S. Provisional Patent Application Nos. 60/125,317 and 60/125,318 both of which are hereby filed Mar. 19, 1999, which are hereby incorporated by reference.

TECHNICAL FIELD OF THE INVENTION

The invention relates to ion pumps used primarily in high and ultra-high vacuum systems.

BACKGROUND OF THE INVENTION

Ion pumps are used in a variety of systems that require a high or ultra-high vacuum. Such systems include focused ion beam systems, electron microscopes, accelerators, molecular beam epitaxial deposition systems, and other analytical, fabrication and research systems and instruments. Ion pumps are typically used at pressures of between $10^{-4}$ Torr and $10^{-11}$ Torr, with pressures of between $10^{-7}$ Torr and $10^{-9}$ Torr being common in, for example, focused ion beam systems.

One type of ion pump is the diode sputter ion pump. FIG. 1 shows a typical diode sputter ion pump 10 consists of two cathodes 12, one on either side of an anode 14. FIGS. 2, 3 and 4 show cross-section of prior art anodes of differing design. Each anode typically includes multiple anode cells 16, each having a longitudinal axis perpendicular to the planes of the cathodes. In operation, a positive voltage is applied to the anode 10, a negative voltage or ground potential is applied to the cathodes 12, and a magnetic field is applied parallel to the longitudinal axes of the anode cells. Within each anode cell 16, electrons are trapped by the magnetic field, creating a stable electron cloud commonly known as a space charge cloud.

The electron cloud is stable because the applied magnetic field constrains the electrons to travel in circular orbits each having a radius known as the cyclotron radius. Moreover, at higher pressures, individual electrons are shielded from the electric field of the anode, through a phenomenon known as Debye screening, by other electrons in the cloud. The distribution of voltages and electrical charges in the system creates near the anode an area of steep potential gradient known as the anode sheath. The anode sheath tends to act as a boundary between the edge of the space charge cloud and the anode. The electrons tend to remain in the cloud until they migrate to the anode, where they are counted as anode current.

Electrons in the cloud collide with and ionize gas molecules that migrate into the cloud. The ionized gas molecules accelerate toward the cathodes 12, sputtering cathode material, typically titanium. The sputtered titanium strikes and adheres to the anode, the cathodes, or elsewhere. Because the titanium is chemically active, gas molecules stick to and/or react with the titanium atoms, and are thereby fixed into a solid state and removed from the gas phase thus lowering the gas pressure in the vacuum chamber, essentially pumping gas from the chamber to create a better vacuum. Noble gas molecules that are not chemically active are removed from the gas phase by being buried under sputtered cathode material or by migrating into the crystal structure of the cathode after impact and being trapped within crystal structure defects in the cathodes.

The pumping characteristics of an ion pump are determined primarily by the gas pressure in the vacuum chamber, the magnetic field, the voltages on the anode and cathodes, the shape of the anode cells, the distances between the anode cells and the cathodes, and the types of gases present. The pump cells are characterized by a sensitivity, which is defined as the ion current divided by the pressure and generally given in amps per Torr. The pump is generally characterized by a pumping speed which varies with the particular gas being pumped because of the different chemical reactions between the sputter cathode material and the particular gas molecule. The pumping speed is generally given in liters per second.

When a gas molecule is ionized by collision with an electron in the anode cell, one or more electrons are freed into the electron cloud. To maintain a steady state, electrons must leave the electron cloud at the same rate that new electrons are added to the cloud by the ionization of gases or by the arrival of secondary electrons due to ion bombardment of the cathode. An excess of electrons in the electron cloud will neutralize the gas ions before they have gained sufficient momentum to efficiently sputter material from the cathode.

By a phenomenon known as cross-field mobility, some electrons penetrate the anode sheath and impact the anode. Electrons in the space charge cloud within about two electron cyclotron radii of the sheath have a significant probability of striking the anode and leaving the cloud. The shape of the anode cell has a significant effect on the contour of the anode sheath and its distance from the anode wall, which contour and distance are also affected by the pressure, the magnetic field, and the applied voltages.

The ion pump anode of FIG. 2 is constructed as a series of rectangular cells, as described, for example, in U.S. Pat. No. 3,319,875 to Jepsen. The anode sheath does not conform well to the walls of a rectangular anode cell at the normal operating pressures of the ion pump, causing the anode sheath to be positioned away from the wall over much of the cell. Because the distance from the edge of the space charge cloud to the anode in many parts of its orbit is beyond the cyclotron radius, electrons in orbit around the edge of the space charge cloud do not have a high probability of striking the anode. Thus, the square cell anode is intrinsically inefficient, that is, has a low sensitivity, and square cell anodes have therefore been largely abandoned in favor of anodes that include a gathered cluster of cylindrical sectors as shown in FIGS. 3 and 4.

In a cylindrical cell anode, the edge of the space charge cloud more closely follows the contour of the anode and therefore more electrons can be within the cyclotron radius of the anode while the parameters that determine the sheath, such as magnetic field, pressure, and voltage, are also conducive to effective pumping. The cylindrical cell maximizes the opportunity of the electrons to make their way to the anode itself, which is in close proximity to the space charge cloud. Thus, ion pumps having cylindrical diode cells are more sensitive than ion pumps having rectangular cells.

Diode sputter ion pumps having cylindrical cell anodes, however, display instabilities typically following pumping exposure to gas doses greater than the ultimate pressure of the vacuum system in which the pump is operating. The instabilities include current bursts, leakage currents, and arcs. The instabilities are disruptive to the devices to which the sputter ion pump is attached. For example, a current burst may stimulate a high voltage discharge that disrupts the electronic sub-systems of the system in which the pump is used. Such disruptions are a known cause of system failure.

SUMMARY OF THE INVENTION

Thus, it is an object of the invention to enhance the operational stability of ion pumps.

Another object of the invention is to enhance the stability of systems into which ion pumps are incorporated.

A further object of the invention to produce an efficient ion pump anode that minimizes or eliminates instabilities caused by the inter-cylindrical cells.

Yet another object of the invention is to minimize or eliminate instabilities caused by the inter-cylindrical cells by eliminating or minimizing the inter-cylindrical cells.

Still another object of the invention is to produce an ion pump anode having a cell configuration that minimizes or eliminates inter-cylindrical cells yet allows for efficient transfer of electrons from the electron cloud to the anode.

Yet a further object of the invention is to provide a method of efficiently manufacturing a stable ion pump.

In a prior art cylindrical anode ion pump as shown in FIG. 3 between each cylinder its nearest neighbors are inter-cylindrical cellular regions, typically having the shape of a hyper-extended square. One of the applicants has discovered that these inter-cylindrical cellular regions or cells contribute to instabilities and are a liability to the clean and quiet operation of the diode sputter ion pump. The inter-cylindrical cells have been found, by one of the applicants, to support a very dense plasma, which encourages the growth of dendrites on the cathode below the inter-cylindrical cell.

Both the size of dendrites and the number of dendrites per unit area on the cathode surface has been found to be greater under the inter-cylindrical cells than elsewhere on the cathode. Such dendrites cause explosive cathode arc emission and field electron emission from the cathode plate, which are responsible for such instabilities as current bursts and leakage currents.

The present invention relates to a sputter ion pump that minimizes or eliminates instabilities caused by the inter-cylindrical cells. The instabilities caused by the inter-cylindrical cells can be eliminated by eliminating or minimizing the inter-cylindrical cell, or by altering the inter-cylindrical cells so that they do not support a dense plasma. A preferred anode cell design eliminates the inter-cylindrical cells entirely, while maintaining substantial conformance of the anode sheath to the anode cell wall to allow electrons leave the electron space charge cloud.

A preferred anode cell is quasi-cylindrical, that is, it approximates a cylinder to the extent consistent with eliminating the inter-cylindrical cell. For efficiency, the difference between the major and minor axes of the quasi-cylinder should preferably be less than or equal to approximately two electron cyclotron radii. The curved walls of the present invention allow the anode sheath to conform sufficiently to the anode wall so that electrons can efficiently leave the electron space charge cloud and strike the anode, while the quasi-cylindrical shape allows the anodes to fill the space of the anode without creating inter-cylindrical cells. Anode cells of the present invention are non-rectangular, thereby eliminating the inefficiencies inherent in prior art rectangular cell anodes.

The present invention also includes a method of making the inventive anode by connecting curved metal strips to form the anode cells. The present invention also encompasses a charged particle beam system that uses the inventive ion pump and therefore exhibits increased stability.

Additional objects, advantages and novel features of the invention will become apparent from the detailed description and drawings of the invention.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF PREFERRED EMBODIMENTS

The applicant has shown that the primary cause of disruptions to clean, quiet, stable ion pump operation is the dendrites formed on the cathode. The formation of dendritic protrusions by ion bombardment has been studied by many authors. See, for example, "Production of Microstructures by Ion Beam Sputtering" by W. Hauffe in Topics in Applied Physics, Vol. 64; *Sputtering by Particle Bombardment III*, Eds. R. Behrisch and K. Wittmaack, Springer-Verlag Berlin Heidelberg, 1991; and "Cone Formation on Metal Targets during Sputtering" by G. K. Wehner and D. J. Hajicek in J. Appl. Phys. Vol. 42, Number 3, Mar. 1, 1971. These references discuss the formation of dendrites by ions bombardment in general, but do not address ion pump instability or show the type of, extent of, and formation conditions of the specific dendritic protrusions found on the cathode plates of ion pumps.

"Sputter Ion Pumps for Low Pressure Operation," Transactions of the National Vacuum Symposium of the American Vacuum Society (Nov. 10, 1963) by S. L. Rutherford suggests that field emission current leakage occurs from sharp points or "whiskers" that often form on the cathodes of sputter ion pumps, but does not provide a way for eliminating the instabilities and does not discuss a formation mechanism or the locations on the cathode plate of the dendrites.

Also, M. Audi and M. Pierini in "Surface Structure and Composition Profile of Sputter-Ion Pump Cathode and Anode" in .J. Vac. Sci. Technol A4(3), 303 (1986) mention needle-shaped formations, but their electron micrographs of the needle shaped formations do not show the sort of dendrites that have been found by applicants. The needle-shaped formations shown in the M. Audi, M. Pierini paper display decisively different topographical features from the dendrites found by applicants and are insufficient to support field emission currents.

One of the applicants has found four major properties of the dendrites formed in ion pumps: 1) the dendrites are formed both inside of and within near proximity of the well known cathode crater that is formed by ion sputtering; 2) the dendrites do not exist outside of the visible zone of the cathode crater; 3) the dendrites are of sufficient aspect ratio to provide the field enhancement necessary to the achievement of field emission of electrons from the dendrites; and 4) the dendritic population density appears to be directly related to the plasma density of the cell.

Figure 1:
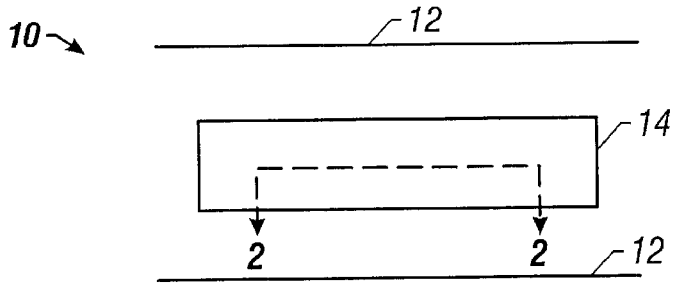
FIG. 1 shows a schematically typical diode ion sputter pump.
Figure 2:
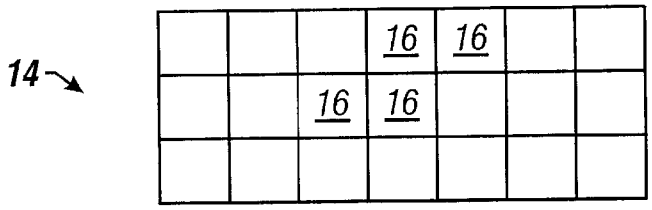
FIG. 2 shows a cross section of a rectangular cell prior art anode for a diode ion pump such as the one shown in FIG. 1.
Figure 3:
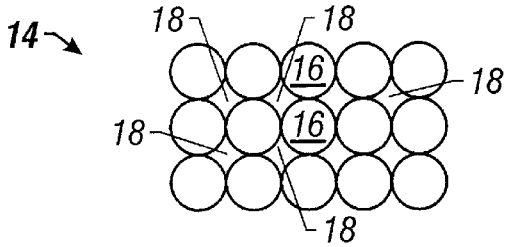
FIG. 3 shows a cross section of cylindrical cell prior art anode for a diode ion pump such as the one shown in FIG. 1.
Figure 5:
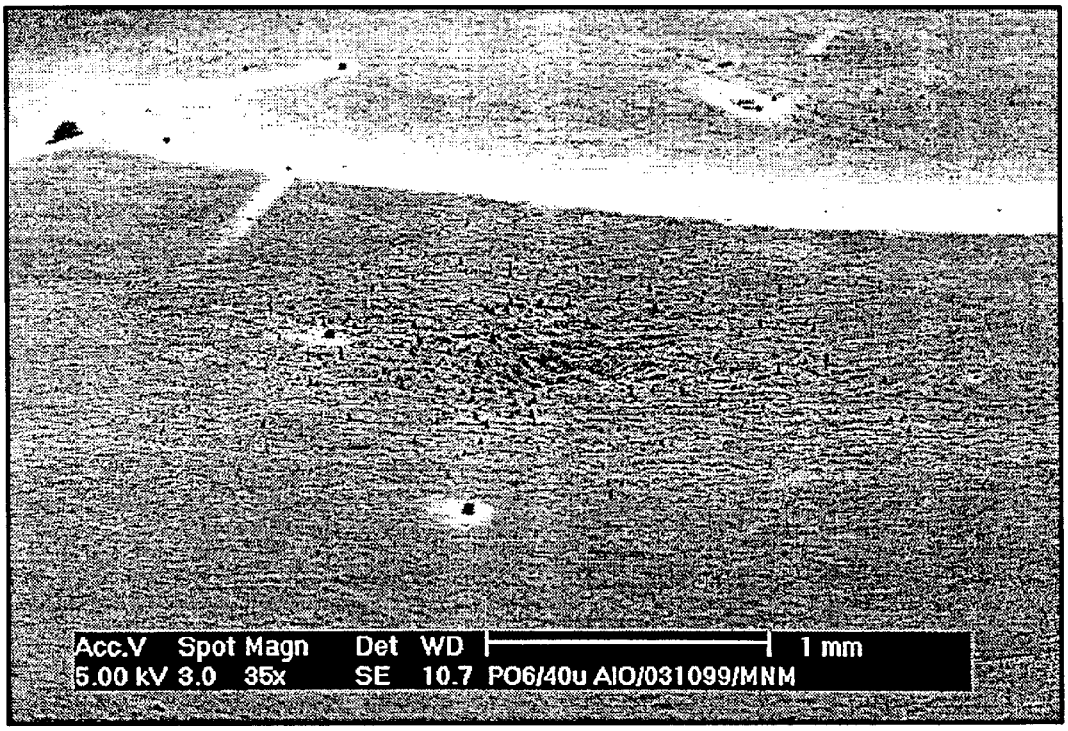
FIG. 5 is an ion micrograph showing on an ion pump cathode dendrites in a region across from an inter-cylindrical anode cell as shown on FIG. 3.
Figure 6:
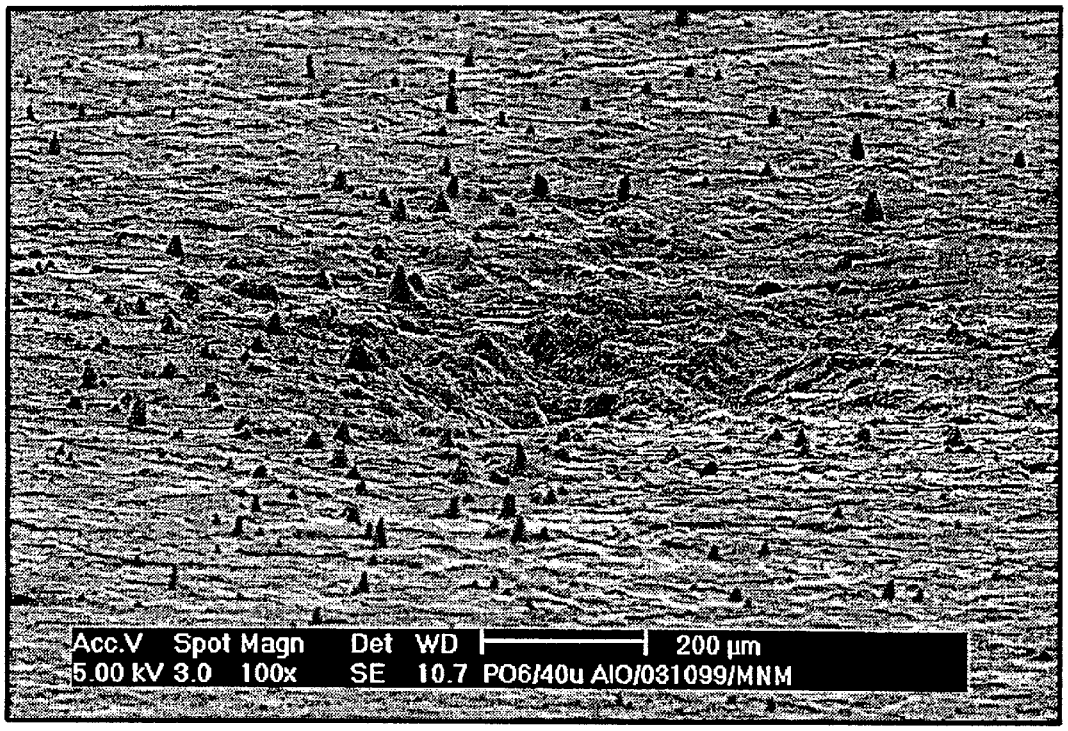
FIG. 6 is an ion micrograph showing the dendrites of FIG. 5 using increased magnification.

At the junctions between linked cylindrical cells 16 of an ion pump anode 14 of FIG. 3 are formed hyper-square inter-cylindrical cells 18 that support plasma densities greater than those of the standard cylindrical cells 16. The higher plasma density causes the cathode crater associated with the inter-cylindrical cells to have a greater dendritic population density than that found on the cathode plate opposite a standard cylindrical anode cell. FIG. 5 is an ion micrograph that shows the field of dendrites clustered in a zone directly about the cathode crater formed by the plasma of an inter-cylindrical cell. The crater is about 1 mm in diameter and the zone about the crater which encloses the forest of dendrites is about 2.5 mm in diameter. FIG. 6 is an ion micrograph that shows a closer view of the dendrites. This dendrites shown in this photo are markedly different than any feature shown in the M. Audi paper. Dendritic protrusions like those shown in FIG. 6 will field emit electrons under the applied field of the anode, particularly at lower operating pressures where the electric field at the cathode surface is greatest. The field emitted electrons lead to the macroscopically observable performance limitations of diode sputter ion pumps, namely instabilities, current bursts, leakage currents, and arcs.

Figure 7:
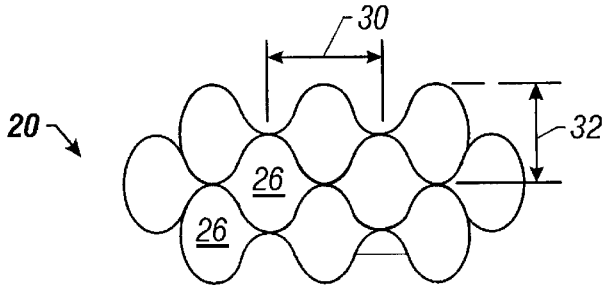
FIG. 7 shows a cross section of an anode embodying the present invention.

Applicants produce a stable ion pump by reducing or eliminating the inter-cylindrical cells while maintaining a design conducive to efficient pumping. A preferred embodiment, shown in FIG. 7, is a corrugated-style anode 20, that efficiently eliminates the inter-cylindrical cells. A sputter diode ion pump employing anode 20 is both efficient and stable than prior art anode structure 14 of FIG. 3, which incorporates the inter-cylindrical cells.

In a preferred embodiment, anode 20 of the diode sputter ion pump is fashioned in a pattern so that each cell 26 is of a regular size and shape and that there are no gaps between anode cells 26. That is, a cross section of the anode shows a repeating pattern that fills a cross-sectional plane within the anode without inter-cylindrical spaces. The variation in diameter within anode cell 26 is, to the extent possible, on the order of two electron cyclotron radii. The electron cyclotron radius is determined by the strength of the applied magnetic field and the electron energy, which is based on its point of separation and the full acceleration potential given by the potential difference between the cathode and the anode. It will be recognized that along the long axis, the cell deviates most from a cylinder and the long dimension 30 varies from the shorter dimension 32 by more than the electron cyclotron radius. Although this deviation does have an effect on the sensitivity of the cell, the effect is minimized by minimizing the deviation from cylindrical symmetry.

The corrugated anode element design of FIG. 7 reduces ion pump current instability by eliminating the inter-cylindrical cell and thus eliminating the buildup of cathode dendrites due to the inter-cylindrical cell, while simultaneously maintaining high discharge efficiency by ensuring that the electron striking distance to the anode is within the cyclotron orbital radius.

The cell dimensions are similar to those anode cell dimensions of typical prior art cylindrical anode cells yet without the intervening inter-cylindrical cell, Typical cell dimensions are for the length of the anode cylinder approximately 1–1.13 inch (25 mm to 29 mm), and for the diameter of the anode cylinder to be approximately 0.7 inch (18 mm). Further, the dimensions of the corrugated anode are to be such that the variation in diameter over most of the corrugated cell is to be on the order of the twice the electron cyclotron radius, which is typically 4 mm. The corrugated anode of said diode sputter ion pump is to be fixed equidistant between two cathode plates as is typical for diode sputter ion pumps.

The anode of the preferred embodiment can be manufactured more efficiently than prior art anodes. For example, the multiple cells of the anode can be constructed of strips of metal, which are appropriately curved and attached together, for example, by welding. The anode could also be fabricated from a single strip of metal that is curved and folded back onto itself to form multiple rows of anode cells.

A typical operating condition for a pump of the present invention in a focused ion beam system include a cathode voltage of about 0 Volts (held at ground potential), an anode voltage of about 5000 Volts, a magnetic field value of about 1200 Gauss, a gas pressure of about $3\times10^{-8}$ Torr, and an anode-to-cathode spacing of 14 mm. The operating parameters vary with the application. Cathode voltages are typically at about 0 Volts, anode voltages ranging from about 3000 to about 7500 Volts, magnetic field values ranging from about 1000 Gauss to about 1300 Gauss, pressures ranging from about $10^{-3}$ to about $10^{-11}$ Torr, and anode-to-cathode spacing ranges from about mm to about 18 mm. Skilled persons can determine the proper setting for any particular application without undue experimentation.

The high sputtering density upon the cathode causes the growth of dendritic protrusions. At the higher pump operating pressures, the electric field at the flat cathode surface is relatively low due to space charge depression. As the pressure in the pump is decreased, the space charge density near the cathode nearly disappears so that the electric field at the cathode surface is that due to the electric field determined directly by the geometry of the cell. As the pressure decreases, the electric field at the cathode surface increases, becoming sufficiently strong at the lower pressures to induce field emission from the dendrites. The field emission causes leakage currents in ion pumps at low pressures after the pump has been exposed to higher pressures. Data on ion pump stability are measured, therefore, by monitoring the leakage current in an ion pump for a given period of time following a controlled exposure of the ion pump to a higher pressure of $N_2$ (Nitrogen) gas. Following an exposure, ion pumps will typically have leakage currents that tend to decay, to some degree, over time, perhaps by an annealing process. The minimum leakage current, Ip, that is achieved in the pump within the monitoring time is then plotted versus the pump exposure lifetime. The plots reveals the lifetime response of the leakage current of the pump and provides a convenient graphical method to understand pump stability performance.

Figure 4:
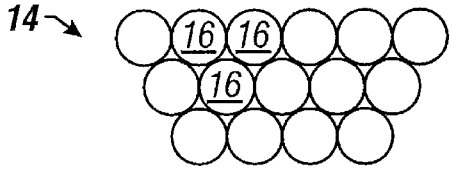
FIG. 4 shows a cross section of close-packed cylindrical cell prior art anode for a diode ion pump such as the one shown in FIG. 1.
Figure 8:
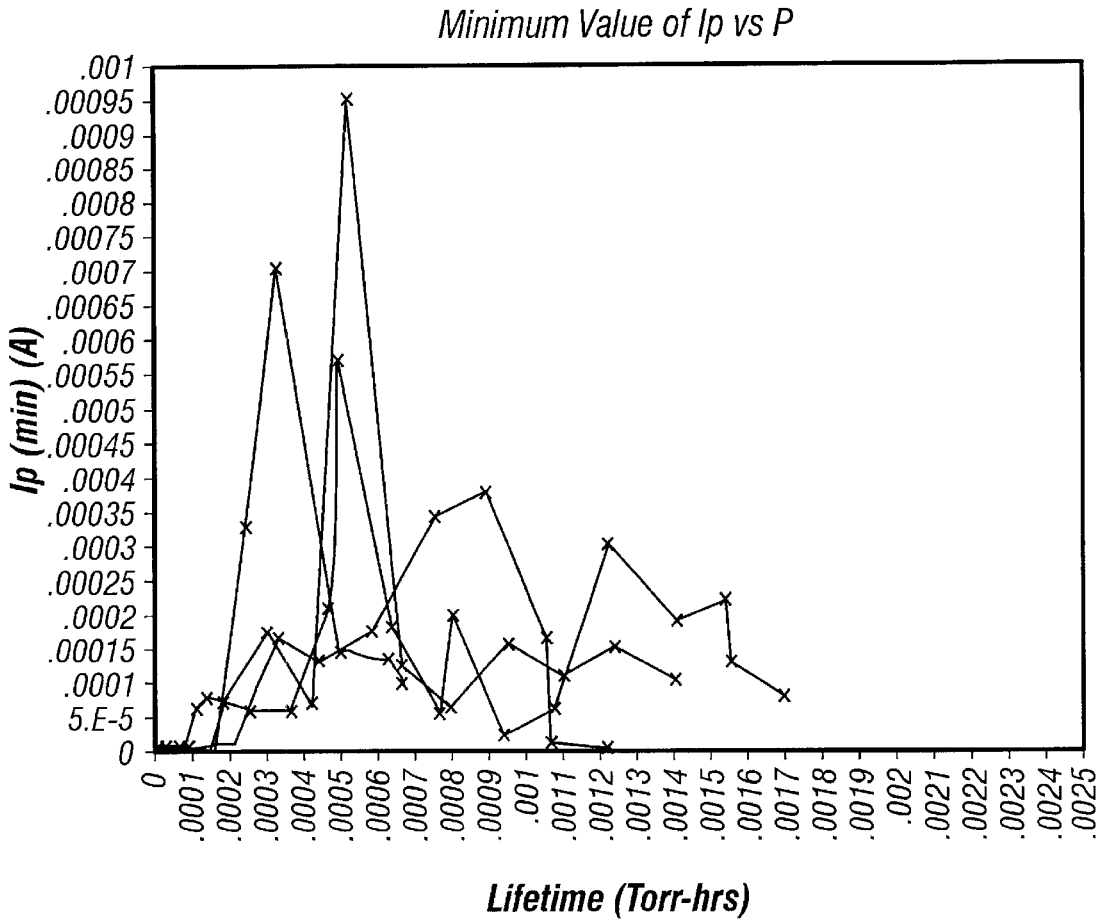
FIG. 8 is a graph showing four measurements of ion pump leakage current over time of an ion pump having anodes as shown in FIG. 3
Figure 9:
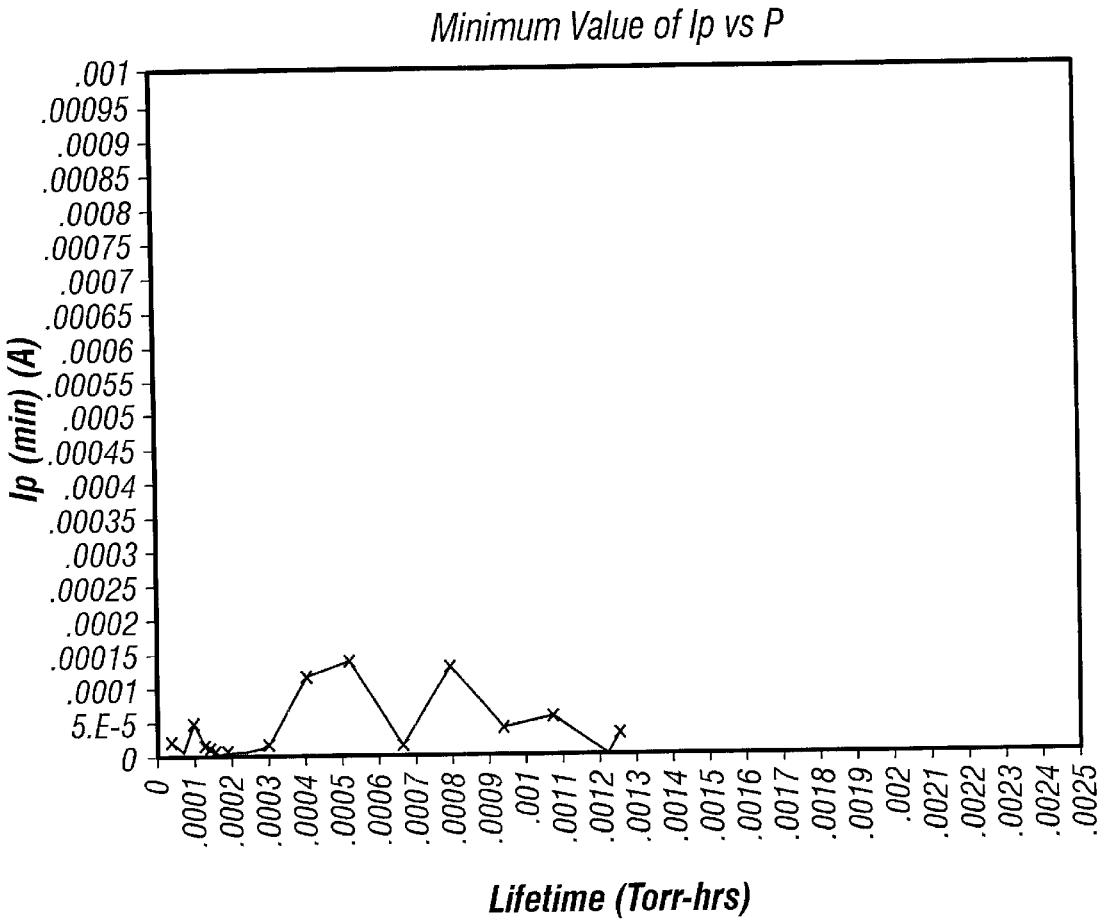
FIG. 9 is a graph showing ion pump leakage current over time of an ion pumps having an anodes as shown in FIG. 4.

FIG. 8 shows four sets of measurements of the lifetime response of prior art pumps with prior art anode structures such as that shown in FIG. 3. One can see that these pumps had significant leakage currents as a result of their gas exposures. FIG. 9 shows the lifetime response of an ion pump as shown in FIG. 4 having a close packed anode structure with minimal inter-cylindrical cells. One can see that the leakage currents in the pump of FIG. 4 is significantly less over the lifetime of the pump than the leakage currents in the pumps of FIG. 3, which have larger inter-cylindrical cells.

Figure 10:
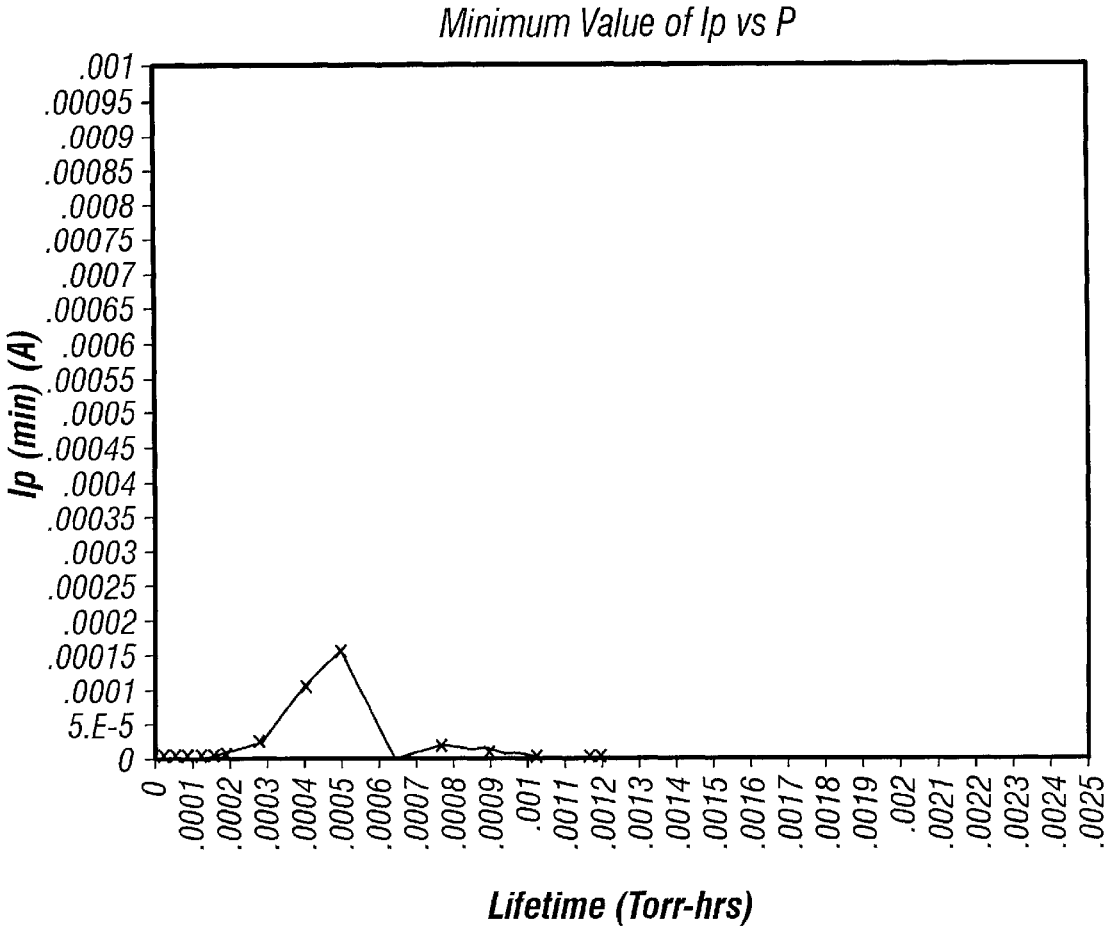
FIG. 10 is a graph showing ion pump leakage current over time of the anode of FIG. 7.

FIG. 10 shows the lifetime response of a pump with a corrugated style anode structure of FIG. 7. One can see from the FIG. 10 that the corrugated anode structure offers a significant improvement over the anode structure of FIG. 3 and possibly some improvement over the closely-packed anode configuration of FIG. 4, thereby verifying the concept that a minimization of the inter-cylindrical anode cell reduces the leakage current in ion pumps. The low leakage current of the pump of FIG. 4 may indicate that the reduced inter-cylindrical cells do not support a dense plasma under the testing conditions. The inventive pump, not having inter-cylindrical cells at all, will never have a problem with a high density plasma in inter-cylindrical cells. Moreover, the electric field at the cathode in a pump incorporating the anode design of FIG. 7 may be less than that in a pump incorporating the anode design of FIG. 4, thereby reducing another factor that contributes to the leakage current.

Although a preferred embodiment is described, any configuration that reduces the effects of the inter-cylindrical cell while allowing the anode sheath to substantially conform to the anode would be useable. By "substantially conform" is meant conforming better than the anode sheath of a rectangular anode at normal pump operating conditions. By the anode cell having a diameter variation of less than or equal to about two electron cyclotron radii throughout a substantial portion of the anode cell is meant having a diameter variation less than or equal to about two electron cyclotron radii over a larger portion of the cell than in a comparable rectangular cell, wherein the diameter variation in a rectangular cell is determined by a diameter through the cell center and rotated around the cell.

The embodiments described above are merely illustrative and skilled persons can make variations on them without departing from the scope of the invention, which is defined by the following claims.

Although the present invention and its advantages have been described in detail, it should be understood that various changes, substitutions and alterations can be made to the embodiments described herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

We claim as follows:

1. An ion pump, comprising:

an anode including multiple anode cells, the anode cells being shaped so that the plasma sheath substantially conforms to the anode walls and the anode cells arranged so as to eliminate intracellular voids;

a source of a magnetic field for maintaining the plasma within the anode cells;

two cathodes, one cathode positioned on either side of and spaced apart from the anode; and a source of an electric field for accelerating particles to sputter the cathode.

2. The ion pump of claim 1 in which the anode cells are quasi-cylindrical.

3. The ion pump of claim 2 in which the anode cell has a minimum diameter and in which the diameter of the anode cell is less than or equal to about two electron cyclotron radii throughout most of the anode cell.

4. The ion pump of claim 1 in which at last some of the walls of different ones of the multiple anode cells are formed from a single piece of metal.

5. An ion pump, comprising:

an anode including multiple non-rectangular anode cells, the anode cells being arranged to eliminate gaps between the multiple anode cells;

a source of a magnetic field for maintaining the plasma within the anode cells;

two cathodes, one cathode positioned on either side of and spaced apart from the anode; a source of an electric field between the anode and the cathode for accelerating particles to sputter the cathode.

6. The ion pump of claim 5 in which the anode cells include arcuate walls.

7. The ion pump of claim 5 in which the anode cells are quasi-cylindrical in shape.

8. The ion pump of claim 7 in which the anode cell has a minimum diameter and in which the diameter of the anode cell is less than or equal to about two electron cyclotron radii throughout most of the anode cell.

9. A method of evacuating a chamber using an ion pump, comprising:

providing an anode having multiple, non-rectangular anode cells, the cells being packed without interstices in the anode;

applying a magnetic field for maintaining a plasma in the anode cells;

providing a cathode including material for sputtering to remove gas from the ion pump environment;

applying an electric field between the anode and cathode, the electric field accelerating ionized gas particles toward cathode into at least one impact area defined by the at least one anode cell.

10. The method of claim 9 in which providing an anode having multiple, non-rectangular anode cells includes providing an anode having quasi-cylindrical anode cells.

11. The method of claim 10 in which providing an anode having quasi-cylindrical anode cells includes providing an anode having cells in which, in each anode cell, the diameter of the cell is within about two electron cyclotron radii throughout most of the anode cell.

12. A charged particle beam system exhibiting improved stability, comprising:

a source of charged particles;

charge particle optics for forming the charged particles into a beam;

a vacuum system for creating an evacuated environment for the charged particle beam, the vacuum system including an ion pump including an anode having non-rectangular anode cells arranged without gaps between them to form the anode, thereby reducing instabilities of the charged particle beam.

13. The charged particle beam system of claim 12 in which the source of charged particles comprises a source of ions.

14. The charged particle beam system of claim 12 in which the source of charged particles comprises a source of electrons.

15. An anode for an ion pump having multiple anode cells, each cell having a shape in which the anode sheath conforms to the anode walls sufficiently to allow efficient transfer of electrons to the anode while minimizing or eliminating the inter-cylindrical cell.

16. The anode of claim 15 in which each cell has a quasi-cylindrical shape.

17. A method of manufacturing an anode for an ion pump, comprising:

bending one or more metal strips into a wave pattern; and connecting together sections of the one or more metal strips to form an array of anode cells, the cells having no interstices between them.

18. The method of claim 17 in which connecting together sections includes welding sections together.

19. The method of claim 17 in which the one or more metal strips comprise multiple metal strips, the multiple strips being connected to form the array of quasi-cylindrical cells.

20. The method of claim 17 in which the one or more metal strips comprise multiple metal strips, the multiple strips being connected to form the array of quasi-cylindrical cells.

21. The method of claim 17 in which the one or more metal strips comprises a single metal strip, the single metal strip folding back on itself to form an array of quasi-cylindrical cells.

* * * * *